US006412773B1

(12) United States Patent
Takagi

(10) Patent No.: US 6,412,773 B1
(45) Date of Patent: Jul. 2, 2002

(54) PAPER FEEDING APPARATUS

(75) Inventor: Masaaki Takagi, Osaka (JP)

(73) Assignee: Funai Electric Co., Ltd., Daito (JP)

( * ) Notice: Subject to any disclaimer, the term of this patent is extended or adjusted under 35 U.S.C. 154(b) by 0 days.

(21) Appl. No.: 09/653,806

(22) Filed: Sep. 1, 2000

(30) Foreign Application Priority Data

Sep. 9, 1999 (JP) ..... 11-255358

(51) Int. Cl.[7] ..... B65H 1/00
(52) U.S. Cl. ..... 271/171; 271/240
(58) Field of Search ..... 271/240, 250, 271/254, 171, 275, 264

(56) References Cited

U.S. PATENT DOCUMENTS 5,091,754 A * 2/1992 Abe et al. ..... 271/240
5,516,093 A * 5/1996 Ballard et al. ..... 271/240
6,149,150 A * 11/2000 Onipchenko et al. ..... 271/240

FOREIGN PATENT DOCUMENTS

JP 1-166550 11/1989
JP 0313250 * 12/1989 ..... 271/240
JP 4-75842 7/1992

* cited by examiner

*Primary Examiner*—H. Grant Skaggs
(74) *Attorney, Agent, or Firm*—Crowell & Moring LLP

(57) ABSTRACT

A paper feeding apparatus has a fixed-side paper guide 5 and a movable-side paper guide 6. A tubular portion 7 of the movable-side paper guide 6 is slidably attached to a guide shaft 4. The guide shaft 4 is rotated by the power for feeding the paper to a paper processing section. The guide shaft 4 is provided with a helical groove 42, and a movable piece 71 having a pawl for engagement with the helical groove 42 is provided on the movable-side paper guide 6. When the guide shaft 4 rotates the movable-side paper guide 6 pushes and moves the paper to a proper position. When the paper is set in the proper position, the pawl is pushed up by a helical projection forming the helical groove 42, and is disengaged from the helical groove 42.

8 Claims, 5 Drawing Sheets

PAPER FEEDING APPARATUS

BACKGROUND OF THE INVENTION

1. Field of the Invention

The present invention relates to a paper feeding apparatus, and more particularly to a paper feeding apparatus for use in, for instance, a printer having a paper processing section (printing section) for effecting printing on paper, and a facsimile apparatus and a copying apparatus having a paper processing section (reading section) for reading data on paper.

2. Description of the Related Art

A paper feeding apparatus adopted in a printer having a printing section as a paper processing section is disclosed in JP-A-4-75842U. In this paper feeding apparatus, the position of a paper guide for restricting the position of setting cassette paper is adapted to be changed in a multiplicity of stages. Further, Japanese Patent Utility Model Publication No. Hei 1-166550 discloses a paper feeding mechanism that is capable of restricting the position of setting recording paper (paper) in a longitudinal direction and a transverse direction.

As can be seen in these publications, in a paper feeding apparatus used in a printer, for example, the position of the paper guide is adjusted in correspondence with the paper size so as to prevent the paper from skewing. A similar operation is effected in a paper feeding apparatus used in a facsimile apparatus and a copying apparatus.

Among the conventional paper feeding apparatuses, an apparatus having a fixed-side paper guide and a movable-side paper guide capable of sliding in a direction of moving toward or away from the fixed-side paper guide is so arranged that the paper is set by being clamped by the fixed-side paper. guide and the movable-side paper guide so as to prevent the paper being fed to the paper processing section (the aforementioned printing section or reading section) from becoming offset from a proper position or skewing. In this paper feeding apparatus, the fixed-side paper guide and the movable-side paper guide which clamp the paper demonstrate the effect of preventing the positional offset of the paper from the proper position. or the skewing of the paper during feeding. In addition, the fixed-side paper guide serves to set the paper setting position at the proper position as the fixed-side paper guide is caused to abut against one lateral end of the paper during paper setting.

In such a paper feeding apparatus, when the paper is set, after an operator places the paper on a paper supporting surface with one lateral end of the paper abutting against the fixed-side paper guide, the operator forcibly slides the movable-side member in a direction in which the movable-side member approaches the fixed-side member, thereby moving the movable-side member to an appropriate position corresponding to the paper size.

However, it is troublesome to effect the operation of sliding the movable-side paper guide in correspondence with the paper size each time the paper is set.

In addition, there are cases where the movable-side paper guide moves due to some cause and is separated from the paper during the feeding of paper to the printing section of the printer or the reading section of the copying apparatus, and if the condition in which the movable-side paper guide is separated from the paper is left as it is, the paper is likely to skew. Accordingly, when it is found out that the movable-side paper guide has separated from the paper, the movable-side paper guide is slid again to be moved to the appropriate position, but that operation has been troublesome.

SUMMARY OF THE INVENTION

The invention has been devised under the above-described circumstances, and its object is to provide a paper feeding apparatus in which even if the position of the paper placed on the paper supporting surface is positionally offset from a proper position, the position of the paper can be corrected to a proper position.

Another object of the invention is to provide a paper feeding apparatus in which the movable-side paper guide automatically returns to an appropriate position even if the movable-side paper guide has been separated from the paper due to some cause during feeding.

The paper feeding apparatus in accordance with the invention comprises: paper-position correcting means for pressing and urging at least one of one lateral end and the other end of paper placed on a paper supporting surface, thereby moving the paper to a proper position on the paper supporting surface so as to position the paper at the proper position. For this reason, when the position of the paper placed on the paper supporting surface has become-positionally offset from a proper. position, the paper-position correcting means presses and urges one or both of the one lateral end and the other lateral end of the paper, thereby moving the paper to the proper position so as to position the paper at the proper position.

In the invention, the power for feeding the paper to the paper processing section is utilized as the force for pressing and urging the one lateral end or the other lateral end of the paper. For this reason, there is an advantage in that it is unnecessary to separately provide a driving source for operating the paper-position correcting means and a power transmitting passage. The "paper processing section" corresponds to a printing section of a printer, a reading section of a facsimile apparatus or a copying apparatus, or the like.

In the paper feeding apparatus of the invention, preferably, there are provided a fixed-side paper guide for positioning the paper at the proper position on the paper supporting surface as the one lateral end of the paper is caused to abut against the fixed-side paper guide, and a movable-side paper guide opposed to the fixed-side paper guide and disposed in such a manner as to be capable of moving toward or away from the fixed-side paper guide, the paper-position correcting means including the movable-side paper guide, the movable-side paper guide being urged in a direction of approaching the fixed-side paper guide so as to press and urge the other lateral end of the paper.

The paper feeding apparatus may be arranged such that the movable-side paper guide is slidably attached to a guide shaft which is rotatably provided along the paper supporting surface, and power for feeding the paper to the paper processing section is transmitted to the guide shaft to cause the guide shaft to rotate. In this case, it is possible to adopt an arrangement in which the paper-position correcting means is formed by the movable-side paper guide, a helical groove provided in the guide shaft, an engaging member engaged with the helical groove to translate rotary motion of the guide shaft to sliding motion of the movable-side paper guide, and a disengaging mechanism for canceling a state of engagement between the engaging member and the helical groove when the paper is clamped by the fixed-side paper guide and the movable-side paper guide and a force for pressing the other lateral end of the paper has reached a fixed magnitude or more.

In accordance with the paper feeding apparatus constructed as described above, when the power for feeding the paper to the paper processing section is transmitted to the guide shaft to rotate the guide shaft, the rotary motion of the guide shaft is translated to the sliding motion of the movable-side paper guide, so that the movable-side paper guide presses and urges the other lateral end of the paper to cause the one lateral end of the paper to abut against the fixed-side paper guide. When the paper is thus clamped by the fixed-side paper guide and the movable-side paper guide and its position is corrected to the proper position, the force for pushing one lateral end of-the paper by the movable-side paper guide increases and assumes a magnitude exceeding a fixed level, so that the disengaging mechanism cancels the state of engagement between the engaging member and the helical groove, thereby keeping the movable-side paper guide at the proper position corresponding to the paper size.

In the paper feeding apparatus in accordance with the invention, preferably, there is provided paper feeding means for feeding the paper to the paper processing section by imparting a feeding force to the paper placed on the paper supporting surface, an input rotating shaft of the paper feeding means being formed by the guide shaft. If this arrangement is adopted, since the guide shaft is jointly used as the input rotating shaft of the paper feeding means, it becomes unnecessary to use the guide shaft separately from the input rotating shaft, so that an increase in the number of component parts can be suppressed.

The engaging member is preferably formed of a synthetic resin integrally with the movable-side paper guide. If this arrangement is adopted, since it is unnecessary to form the engaging member as a separate component, an increase in the number of component parts can be suppressed.

Preferably, a tubular portion fitted slidably to the guide shaft is provided on the movable-side paper guide, and the engaging member is formed by a pawl provided at a distal end of a resilient movable piece which is formed by forming. split grooves at two positions in a tubular wall of the tubular portion and is flexurally deformable in inward and outward directions of the tubular portion. If this arrangement is adopted, a guide member necessary for slidingly moving the movable-side paper guide is jointly used by the guide shaft. In addition, since the movable piece of the engaging member is formed by one portion of the tubular wall of the tubular portion, it becomes unnecessary to provide the tubular portion and the engaging member at separate positions.

Preferably, the disengaging mechanism has an inclined surface provided on the pawl, and is so arranged that when the paper is clamped by the fixed-side paper guide and the movable-side paper guide and the force for pressing the other lateral end of the paper by the movable-side paper guide has reached the fixed magnitude or more, a helical projection forming the helical groove presses the inclined surface to cause the pawl to be lifted up from the helical groove and to be disengaged therefrom. According to this arrangement, it is unnecessary to form a complicated mechanism as the disengaging mechanism, and the disengaging mechanism can be constructed simply, so that the paper feeding apparatus can be provided at the low costs.

In addition, a grip for causing the pawl to be disengaged from the helical groove by deflecting the movable piece-against its resiliency is-preferably provided in such a manner as to be connected to the movable piece. If this arrangement is adopted, in a case where there has arisen a need to move the movable-side paper guide horizontally by a large distance, the movable-side paper guide can be slidingly moved by simply disengaging the pawl from the helical groove by operating the grip without rotating the guide shaft.

BRIEF DESCRIPTION OF THE DRAWINGS

FIG. 3 is a schematic perspective view illustrating a movable-side paper guide and the like;

DETAILED DESCRIPTION OF THE PREFERRED EMBODIMENTS

Figure 1:
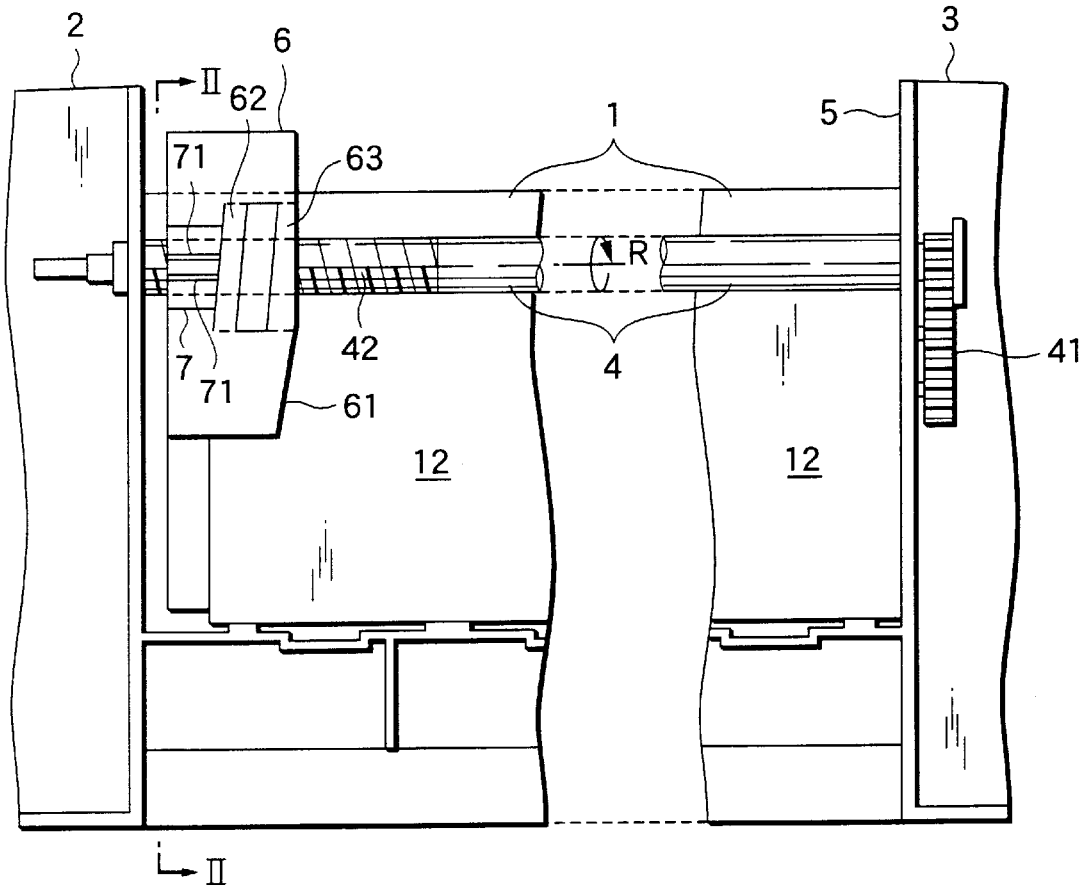
FIG. 1 is a fragmentary schematic front elevational view illustrating an embodiment of a paper feeding apparatus in accordance with the invention.
Figure 2:
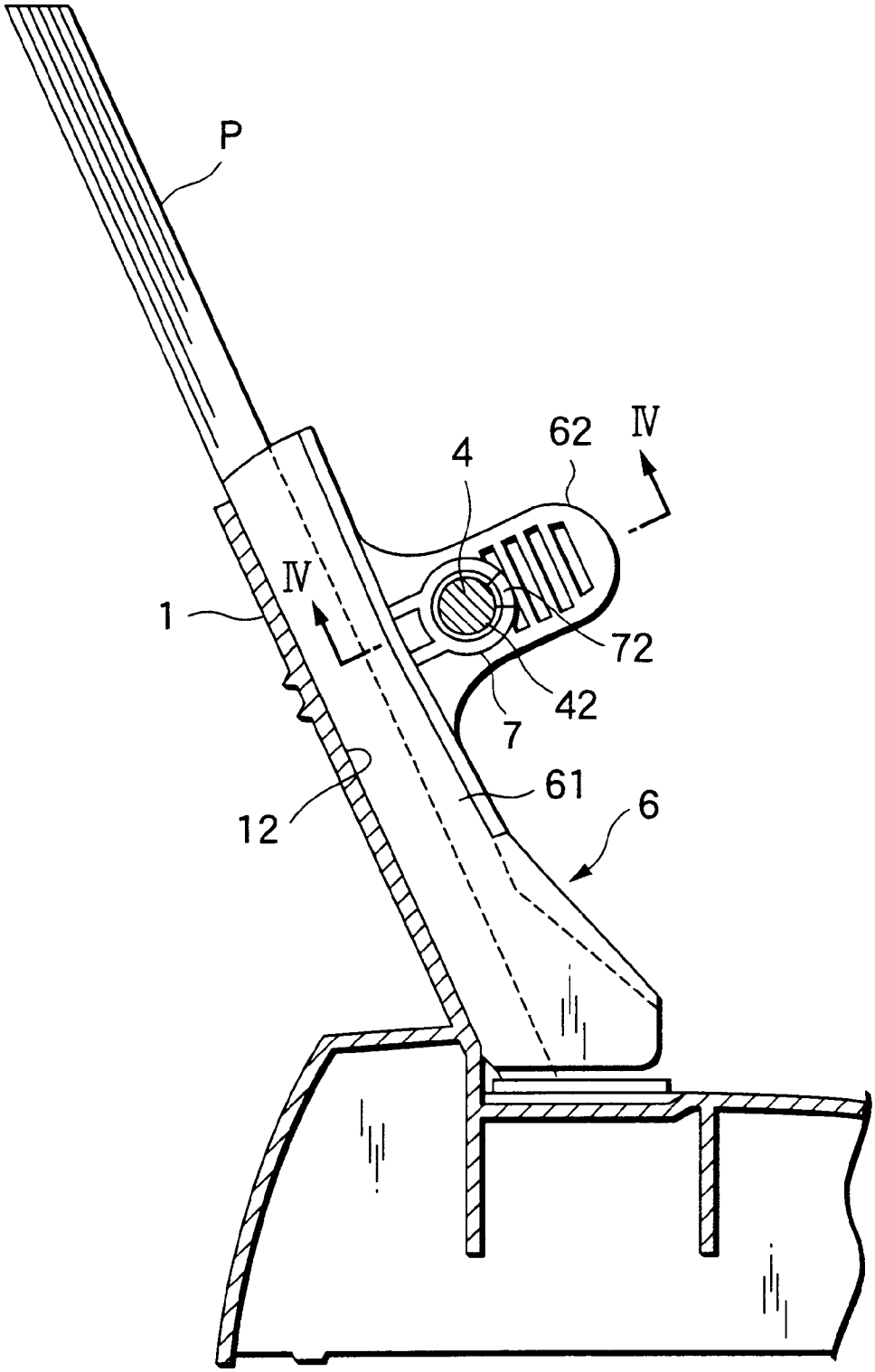
FIG. 2 is a schematic vertical cross-sectional view of a portion taken along line II—II in FIG. 1.
Figure 3:
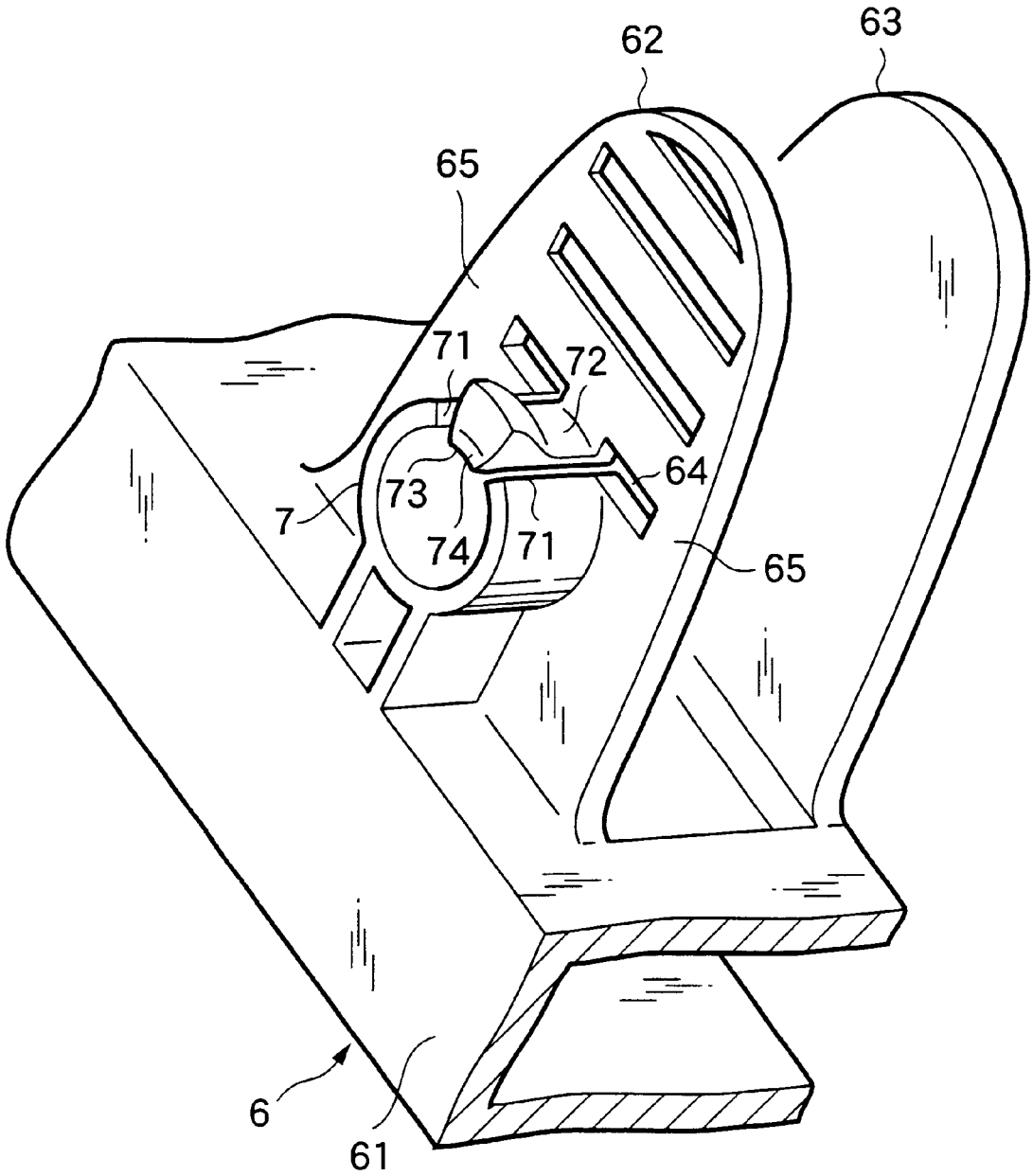
Figure 4:
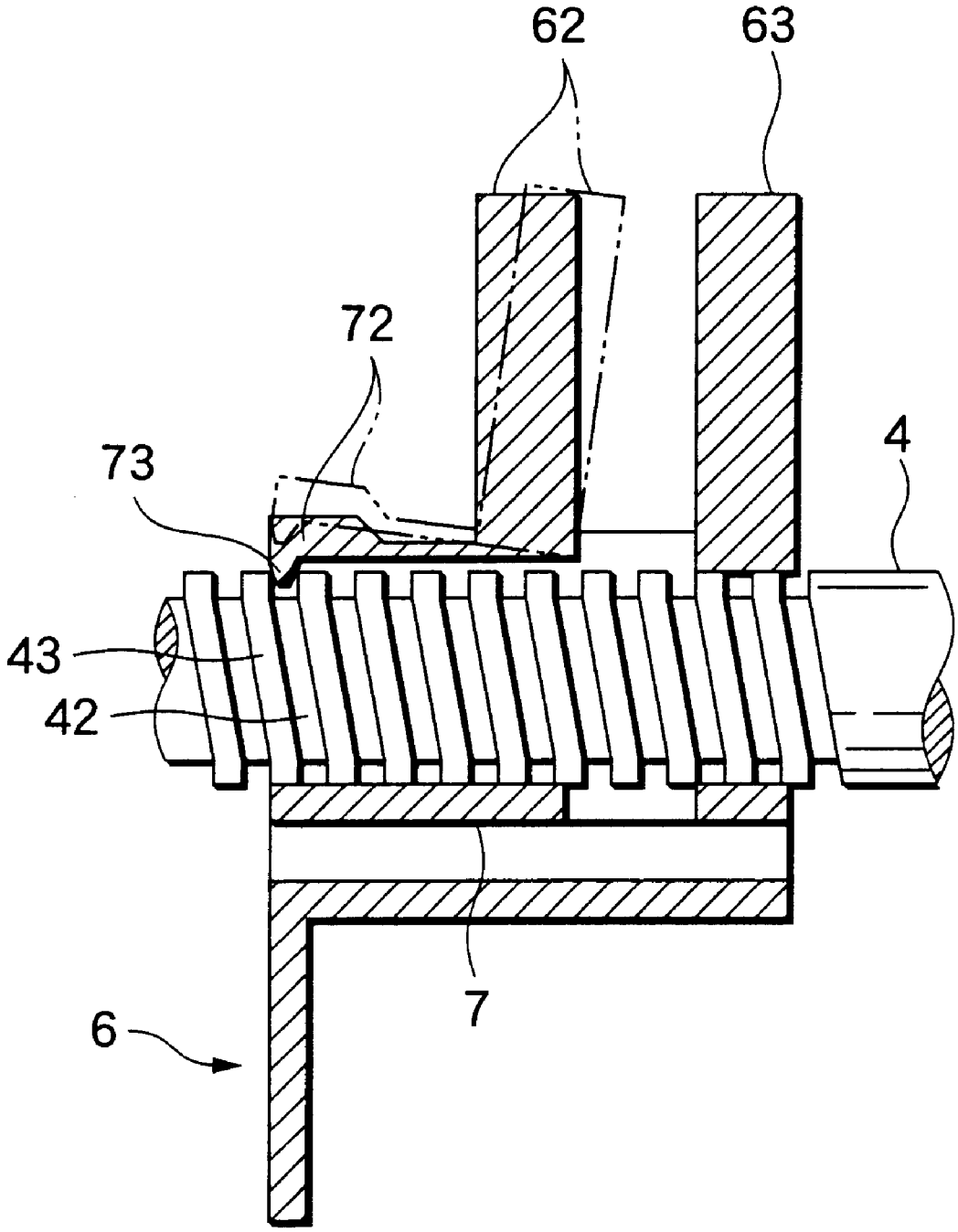
FIG. 4 is an enlarged cross-sectional view of a portion taken along line IV—IV in FIG. 2.
Figure 5:
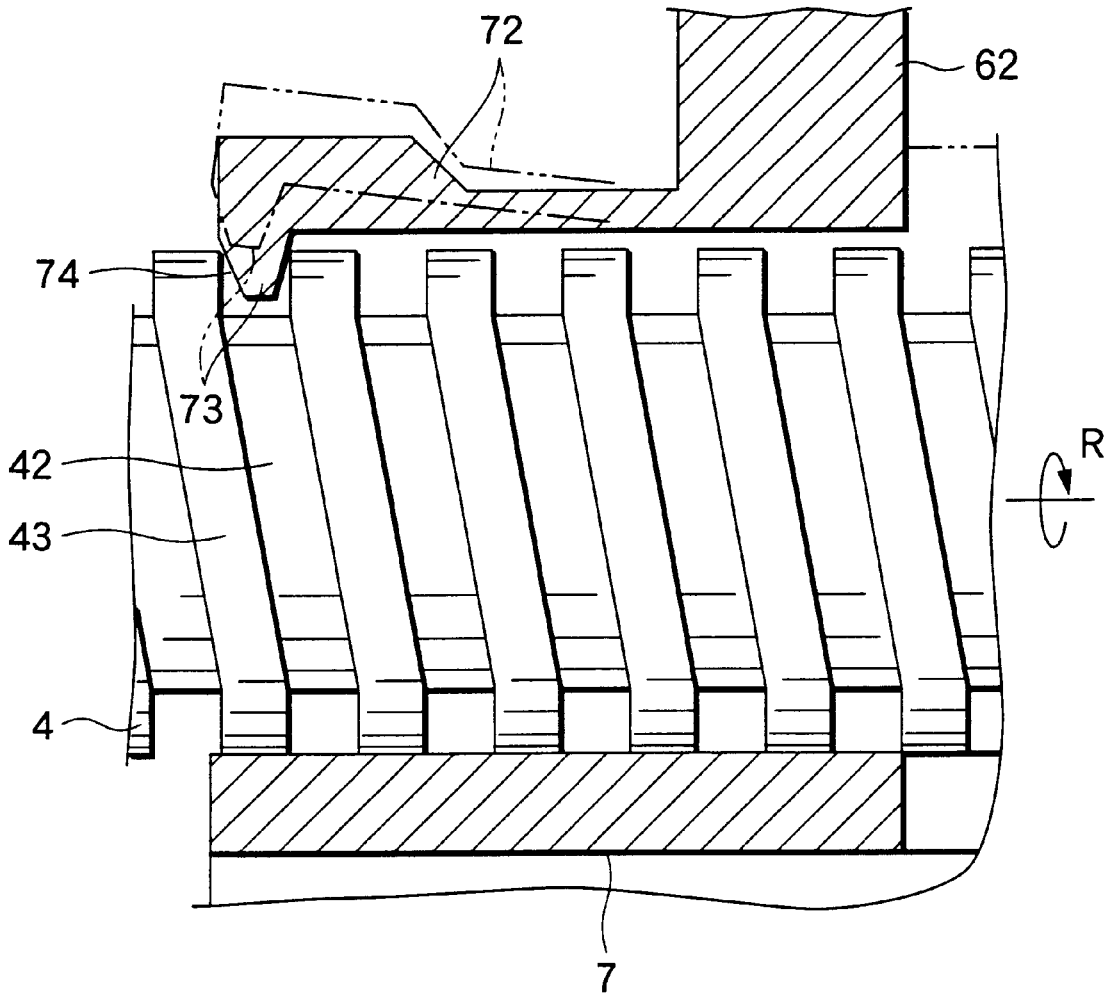
FIG. 5 is an enlarged view of an essential-portion shown in FIG. 4.

The numerous features and operation of the invention will become apparent from the embodiment which will be described below. FIG. 1 is a fragmentary schematic front elevational view illustrating an embodiment of the paper feeding apparatus in accordance with the invention. FIG.2 is a schematic vertical cross-sectional view of a portion taken along line II—II in FIG. 1. FIG. 3 is a schematic perspective view illustrating a movable-side paper guide and the like. FIG. 4 is an enlarged cross-sectional view of a portion taken along line IV—IV in FIG. 2. FIG. 5 is an enlarged view of an essential portion shown in FIG. 4.

As shown in FIGS. 1 and 2, this paper feeding apparatus includes, among others, a backing plate 1 whose surface is formed as a paper supporting surface 12; frame portions 2 and 3 disposed on both left- and right-hand sides of the backing plate 1; a horizontal guide shaft 4 horizontally extending rotatably between the frame portions 2 and 3 in such a manner as to extend parallel to the paper supporting surface 12; a fixed-side paper guide 5 (not shown in FIG. 2) formed by an inner surface of the right-hand frame portion 3 in FIG. 1; and a movable-side paper guide 6 attached slidably to the guide shaft 4. In addition, although not shown, a gear box incorporating a gear train interlocking with the guide shaft 4 is attached to the guide shaft 4 in a suspended manner in such a manner as to be rotatable relative thereto, and a paper feed roller for imparting a feeding force to the paper is attached to a lower end portion of the gear box by coming into contact with the paper placed on the paper supporting surface 12. Here, the paper feed roller is one example of the paper feeding means. Accordingly, in the illustrated embodiment, the guide shaft 4 is used jointly by an input rotating shaft of the aforementioned paper feeding means. In addition, as shown in FIG. 1, a gear train 41 is connected to a right-hand end portion of the guide shaft 4, and the rotational movement of an unillustrated drive motor (driving source) is adapted to be transmitted to the guide shaft 4 through the gear train 41. Further, as shown in FIGS. 1, 2, 4, and 5, a helical groove 42 is formed in a predetermined range of the left-hand end side of the guide shaft 4. It should be noted that the helical direction of the helical groove 42 is set in a direction in which the helical groove 42 is able to feed a pawl 73 in the direction of approaching the fixed-side paper guide 5 when the movable-side paper guide 6 is rotated and the aforementioned paper feed roller feeds the paper to a paper processing section.

As can be seen on viewing FIGS. 2 and 3 together, the movable-side paper guide 6 has a U-shaped paper-end holding portion 61, so that the other lateral end-side portion of one sheet, or portions of stacked sheets, of paper P (see FIG. 2) can be held by the paper-end holding portion 61. In addition,4 a tubular portion 7 is integrally formed of a synthetic resin on the paper-end holding portion 61 in such a manner as to be oriented horizontally. A pair of split grooves 71 are respectively formed at two circumferential positions in a tubular wall of this tubular portion 7, and a narrow movable piece 72, is formed by the pair of split grooves 71. As shown in FIGS. 4 and 5, a proximal portion of the movable piece 72 is thin-walled, and the movable piece 72 is flexurally deflectable in inward and outward directions of the tubular portion 7 by the resiliency of the thin-walled portion. Further, a pawl 73 projects inwardly from a distal end of the movable piece 72, and the pawl 73 has an inclined surface 74, as shown in FIG. 5.

Further, a pair of left and right grips 62 and 63 are integrally formed of a synthetic resin on the paper-end holding portion 61 of the movable-side paper guide 6. Of these, one grip 62 is provided in such a manner as to be connected to proximal portions of the tubular portion 7 and the movable piece 72 mentioned above. In addition, a pair of openings 64 are formed in the grip 62, so that both side portions 65 sandwiching that portion of the grip 62 which is connected to-the movable piece 72 are made resiliently deformable as compared-to other portions. Accordingly, if the pair of left and right grips 62 and 63 are gripped by fingers and one grip 62 is inclined toward the other grip 63, as shown by phantom lines in FIG. 4, the movable piece 72 is deformed in such a manner that its-distal end rises upward by following the flexural deformation of one grip 62, and the pawl 73 at the distal end of the movable piece 72 is displaced on the outer side of the tubular portion 7.

As shown in FIGS. 1, 2, 4 and 5, the movable-side paper guide 6 is slidably attached to the guide shaft 4 as the aforementioned tubular portion 7 is fitted on the guide shaft 4. In the attached state, the paper-end holding portion 61 is slidably brought into contact with the paper supporting surface 12 of the backing plate 1, and the pawl 73 at the distal end of the movable piece 72 is fitted in the helical groove 42 of the guide shaft 4 and is engaged with the helical groove 42.

A description will be given of the paper feeding apparatus constructed as described above.

In the state in which the movable-side paper guide 6 is located by being sufficiently spaced apart from the fixed-side paper guide 5, after the paper P is placed on the paper supporting surface 12 of the backing plate 1, when the guide shaft is rotated in the direction of arrow R in FIGS. 1 and 5, the pawl 73 engaged with the helical groove 42 of the guide shaft 4 is fed in the direction of approaching the fixed-side paper guide 5 by the helical groove 42, so that the movable-side paper guide 6 also moves in the direction of approaching the fixed-side paper guide 5. At this time, the movable-side paper guide 6 moves smoothly while the tubular portion 7 is being guided by the guide shaft 4. When the movable-side paper guide 6 is slidingly moved in the direction of approaching the fixed-side paper guide 5, the paper-end holding portion 61 of the movable-side paper guide 6 presses and urges the other lateral end-side portions of the paper P fitted in the paper-end holding portion 61, specifically the other lateral ends of the paper P, so that the paper P is pushed in the direction of approaching the fixed-side paper guide 5, and one widthwise ends of the paper P are caused to abut against the fixed-side paper guide 5, thereby allowing the paper P to be positioned at the proper position. When one widthwise ends of the paper P are thus caused to abut against the fixed-side paper guide 5, the force for pushing one lateral ends of the paper by the movable-side paper guide 6 increases and assumes a magnitude exceeding a fixed level. When this state is reached, the movement of the movable-side paper guide 6 is hampered by the paper P, a helical projection 43 forming the helical groove 42 presses the inclined surface 74 of the pawl 73 to cause the inclined surface 74 to ride on the helical projection 43. Hence, the pawl 73 is lifted up from the helical groove 42 and is disengaged therefrom, as shown by the phantom. lines in FIG. 5. For this reason, the paper P is clamped by the fixed-side paper guide 5 and the movable-side paper guide 6, and is kept in the state of being positioned at the proper position. Accordingly, even if the paper is fed to the paper processing section, the paper P is prevented from skewing or the like.

In addition, even if a situation has occurred in which the movable-side paper guide 6 recedes from the proper position due to some cause during the feeding of paper to the paper processing section, the movable-side paper guide 6 which receded is automatically returned by the aforementioned feeding action based on the engagement between the helical groove 42 and the pawl 73.

As described above, this paper feeding apparatus is provided with the paper feeding means for feeding the paper P to the paper processing section by imparting the feeding force to the paper P placed on the paper supporting surface 12, and the input rotating shaft of the paper feeding means is formed by the aforementioned guide shaft 4, so that when the action of the paper feeding means is started, the guide shaft 4 also starts to rotate. Accordingly, there is an advantage that the power for feeding the paper P to the paper processing section is effectively utilized as the force with which the movable-side paper guide 6 presses and urges the other lateral ends of the paper P, and there is another advantage that the paper-position correcting action by the movable-side paper guide 6 is, always demonstrated during feeding.

In addition, in this embodiment, the movable-side paper guide 6 has the grip 62, and by inclining the grip 62 toward the grip 63, the pawl 73 can be caused to come off the helical groove 42 and to be displaced on the outer side of the tubular portion 7, as shown by the phantom lines in FIG. 4. Therefore, it is also possible to forcibly slide the movable-side paper guide 6 to the left or the right along the guide shaft 4 by a large distance in such a manner. If this feature is made use of, the movable-side paper guide 6 can be moved quickly to a proper position corresponding to the paper size.

In the above-described embodiment, a description has been given of the paper feeding apparatus in which the position of the fixed-side paper guide 5 serves as a reference position at the time of setting the paper P at the proper position. However, the paper feeding apparatus in accordance with the invention includes an apparatus which has a pair of movable paper guides on the left and right sides, and the center position of the paper supporting surface is set as the proper setting position of the paper. In such a paper feeding apparatus, it suffices if the tubular portion, the movable piece, and the pawl provided in the movable-side paper guide 6 described in the embodiment are provided for each of the left and right paper guides, and helical grooves whose helical directions are mutually opposite are provided on the left and right end portion sides of the guide shaft 4, respectively.

In the above-described embodiment, the paper-position correcting means is formed by the movable-side paper guide 6, the helical groove 42 provided on the guide shaft 4, the engaging member formed by the pawl 73, and the inclined surface 74 of the pawl 73. This paper-position correcting means is adapted to-exhibit the action of pressing and urging at least one of one lateral end and the other lateral end of the paper P placed on the paper supporting surface 12 by making use of the power for feeding the paper P to the paper processing section, as well as the action of positioning the paper P at a proper position by moving the paper P to the proper position on the paper supporting surface 12.

In addition, the inclined surface 74 provided on the pawl 73 forms a disengaging mechanism. This disengaging mechanism exhibits the action whereby when the paper P is clamped by the fixed-side paper guide 5 and the movable-side paper guide 6 and the force for pushing the other lateral end of the paper P by the movable-side paper guide 6 reaches a fixed magnitude or more, the helical projection 43 presses the inclined surface 74, so that the pawl 73 is lifted up from the helical groove 42 and is disengaged therefrom.

As described above, in accordance with the invention, when the paper. placed on the paper supporting surface has been positionally offset from a proper position, that position of the paper is automatically positionally corrected to the proper position. For this reason, it is unnecessary for the operator t effect the troublesome operation of sliding the movable-side paper guide to a proper position after placing the paper on the paper supporting surface, so that the ease of use improves correspondingly. In addition, even in cases where a situation has occurred in which the movable-side paper guide becomes separated from the paper due to some cause during feeding, since the movable-side paper guide is adapted to automatically return (reset) to the proper position, even if the movable-side paper guide moves and is separated from the paper due to some cause during feeding, the movable-side paper guide automatically returns to the proper position, thereby preventing the skewing of the paper.

What is claimed is:

1. A paper feeding apparatus, comprising:

paper-position correcting means for pressing and urging at least one of one lateral end and another lateral end of paper placed on a paper supporting surface, by making use of power for feeding the paper to a paper processing section, to move the paper to a proper position on a paper supporting surface so as to position the paper at a proper position;

a movable-side paper guide being slidably attached to a guide shaft which is rotatably provided along the paper supporting surface, and power for feeding the paper to said paper processing section is transmitted to said guide shaft to cause said guide shaft to rotate; and wherein said paper-position correcting means is formed by said movable-side paper guide, a helical groove provided in said guide shaft, an engaging member engaged with said helical groove to translate rotary motion of said guide shaft to sliding motion of said movable-side paper guide, and a disengaging mechanism for canceling a state of engagement between said engaging member and said helical groove when the paper is clamped by said fixed-side paper guide and said movable-side paper guide and a force for pressing the other lateral end of the paper has reached a fixed magnitude or more.

2. The paper feeding apparatus according to claim 1, further comprising: paper feeding means for feeding the paper to said paper processing section by imparting a feeding force to the paper placed on the paper supporting surface, an input rotating shaft of said paper feeding means being formed by a guide shaft.

3. The paper feeding apparatus according to claim 1, wherein said engaging member is made of a synthetic resin integrally with said movable-side paper guide.

4. The paper feeding apparatus according to claim 3, wherein a tubular portion fitted slidably to said guide shaft is provided on said movable-side paper guide, and said engaging member is formed by a pawl provided at a distal end of a resilient movable piece which is formed by forming split grooves at two positions in a tubular wall of said tubular portion and is flexurally deformable in inward and outward directions of said tubular portion.

5. The paper feeding apparatus according to claim 4, wherein said disengaging mechanism has an inclined surface provided on said pawl, and is so arranged that when the paper is clamped by said fixed-side paper guide and said movable-side paper guide and the force for pressing the other lateral end of the paper by said movable-side paper guide has-reached the fixed magnitude or more, a helical projection forming said helical groove presses said inclined surface to cause said pawl to be lifted up from said helical groove:and to be disengaged therefrom.

6. The paper feeding apparatus according to claim 4, further comprising: a grip for causing said pawl to be disengaged from said helical groove by deflecting said movable piece against its resiliency so as to be connected to said movable piece.

7. The paper feeding apparatus according to claim 1, wherein said paper processing section is one of a printing section for effecting printing on the paper and a reading section for reading data on the paper.

8. The paper feeding apparatus according to claim 1, further comprising:

fixed-side paper guide for positioning the paper at the proper position on the paper supporting surface as the one lateral end of the paper is caused to abut against said fixed-side paper guide; and a movable-side paper guide opposed to said fixed-side paper guide and disposed so as to move toward or away from said fixed-side paper guide;

wherein said paper-position correcting means includes said movable-side paper guide, said movable-side paper guide being urged in a direction of approaching said fixed-side paper guide so as to press and urge the other lateral end of the paper.

* * * * *